US008431026B2

(12) United States Patent
Sharpe

(10) Patent No.: US 8,431,026 B2
(45) Date of Patent: Apr. 30, 2013

(54) APPARATUS TO EXTRACT MAGNETIC PARTICLES FROM SUSPENSIONS

(76) Inventor: Anthony N. Sharpe, Almonte (CA)

( * ) Notice: Subject to any disclaimer, the term of this patent is extended or adjusted under 35 U.S.C. 154(b) by 393 days.

(21) Appl. No.: 12/968,283

(22) Filed: Dec. 15, 2010

(65) Prior Publication Data

US 2011/0198294 A1 Aug. 18, 2011

(51) Int. Cl.
*B03C 1/02* (2006.01)

(52) U.S. Cl.
USPC ..... 210/695; 210/222; 435/173.9; 435/239; 436/526

(58) Field of Classification Search ..... 210/222, 210/695; 435/173.9, 239; 436/526
See application file for complete search history.

(56) References Cited

U.S. PATENT DOCUMENTS

2010/0144005 A1* 6/2010 Bin Kingombe et al. .. 435/173.9

* cited by examiner

*Primary Examiner* — David A Reifsnyder
(74) *Attorney, Agent, or Firm* — Ronald G. Bitner

(57) ABSTRACT

A system for concentrating magnetic particles suspended in a fluid comprising a vessel for containing said fluid having an inner base surface that slopes downwards towards a collection region, the collection region including a retrieval well for collecting magnetic particles; a magnet assembly for positioning under and in proximity with the vessel for attracting magnetic particles to the bottom surface of the vessel, said magnet assembly providing a relatively larger magnetic flux density at a peripheral region thereof; means for laterally traversing the magnet assembly relative to the vessel between a first position whereby the magnet is generally centered under the vessel and a second position whereby the peripheral portion of the magnet is positioned under the well of the vessel; and agitation means for agitating said vessel to facilitate movement of the magnetic particles to the well, where the concentrated particles can be easily removed. The system facilitates analysis of relatively large volume samples.

10 Claims, 3 Drawing Sheets

Fig.8
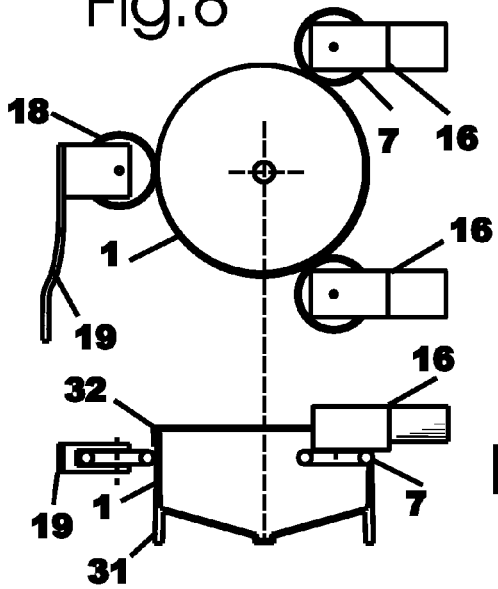
Fig.9
Fig.10
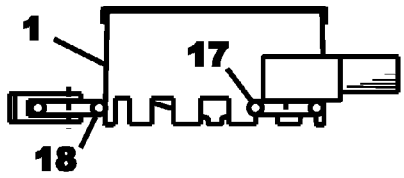
Fig.11
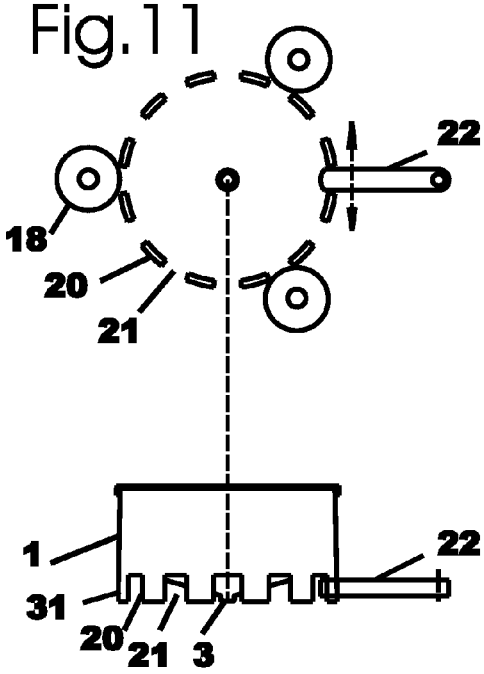
Fig.12
Fig.13
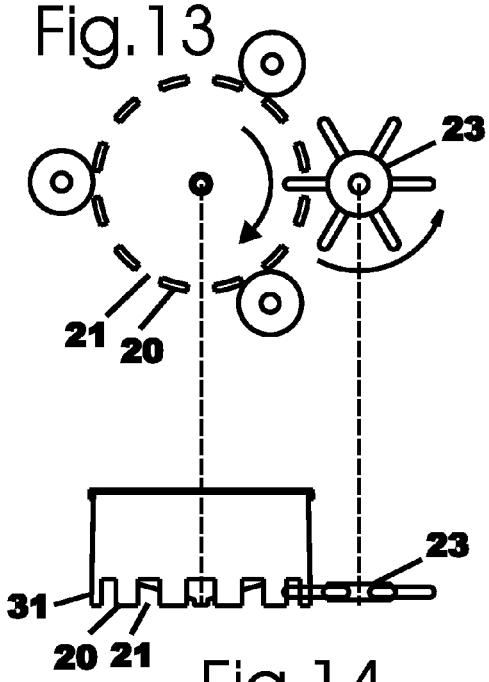
Fig.14

APPARATUS TO EXTRACT MAGNETIC PARTICLES FROM SUSPENSIONS

BACKGROUND OF THE INVENTION

1. Field of the Invention

This invention relates to an apparatus for extracting magnetic particles suspended in a fluid, and particularly for sedimenting and concentrating immunomagnetic particles for analysis.

2. Description of Prior Art

The general technology of using antibody-coated magnetic beads or other magnetic particles, hereinafter referred to as immunomagnetic particles or IMPs, to selectively separate and capture analytes from foods or other samples is known as immunomagnetic separation (IMS) and is widely used. In a typical IMS procedure IMPs are suspended in a suspension of the test sample for a time sufficient for them to selectively bind the target analyte and are then pulled out of the suspension as a small pellet-like sediment by means of a strong magnet. After pouring or pipetting away the supernatant suspension the IMPs can be rinsed by resuspending the pellet in clean diluent and resedimenting it with the magnet, after which the target analyte-bearing IMPs can be introduced into whatever final procedure has been chosen to detect or quantify the target analyte. As each sedimentation usually requires only seconds, capture by IMPs is a convenient and rapid first step in many analyses.

Many different systems and individual pieces of apparatus have been developed to assist the use of IMS. A strong magnet is required in order to maximise the speed with which IMPs can be drawn down and generally the magnets used in these systems are of the Neodymium-Iron-Boron alloy type, commonly referred to as "rare earth magnets". The sedimenting force acting on an IMP at any point in the suspension depends on the magnetic flux density at that point, and because this usually decreases very rapidly with increasing distance from the surface of a magnet, IMP systems are generally designed to handle small volumes, for example 1-10 mL, in small tubes such as the Eppendorf or similar-sized centrifuge tubes commonly found in analytical laboratories.

This small volume results in a limit on the detectable quantity or concentration of target analyte that is often too high for the requirements. For example, if a regulatory standard demands that *Listeria monocytogenes* must not be detectable in a 25 g sample of food then an acceptable *Listeria* detection procedure must be capable of detecting the presence of even a single cell of the bacterium in a sample. However as no known technique can detect such a target analyte until it has been removed from the test sample into liquid suspension the first step in any analysis would be to shake or blend the 25 g sample with 225 mL of sterile diluent. The single cell the analysis must detect may now be anywhere in the 250 mL volume of sample-plus-diluent and the probability of capturing it in even a 10 mL aliquot by means of IMPs will be unacceptably low. Without means to treat the whole 250 mL suspension by IMS the only recourse is to incubate the suspension for hours or days to allow the target cells to multiply to a high enough concentration that the aliquot has a reasonable probability of containing target cells. This time delay is a serious impediment to rapid analysis.

A commercially available system for capturing microorganisms from 250 mL volumes using IMPs (Pathatrix™, Matrix MicroScience Limited, Lynxx Business Park, Fordham Rd, Newmarket, UK), comprises a set of peristaltic pumps, vessels, tubes and in-line filters. The magnet and IMP-capturing dimensions of this system are essentially similar to those used in the small-tube apparatus described above and the system is able to handle the larger volume by pumping the suspension slowly and continually past the magnet. This requires time, although protocols for using the Pathatrix™ system may include time for multiplication of a target microorganism. Assembling its tubes and vessels and removing the captured IMP pellet for introduction to the detection step of an analysis is inconvenient and time consuming. Therefore, it would be desirable to have a simpler and faster means to rapidly capture IMPs from large volumes without need for tubes and pumps.

In my previous Canadian patent application, CA 2685229 to C. I. Bin Kingombe and A. N. Sharpe, it is disclosed that it is possible first to sediment IMPs from 250 mL of suspension to the base of a 500 mL glass Erlenmeyer (conical) flask by standing the flask over a powerful magnet and then to induce them to concentrate to a "pellet" at the centre of the base by intensely vibrating the flask axially at high frequency over a second magnet assembly arranged to produce a magnetic field radiating horizontally from the centre of the base. This vigorous vibration is required to overcome stiction of IMPs against the glass. While this device may be useful in a research laboratory, it has numerous shortcomings that make it quite unsuited for routine use in analytical laboratories. For example the concave conical flask base makes it difficult for a motivating magnetic field situated beneath the flask to persuade IMPs to move "uphill" so that it is necessary for the apparatus to vibrate noisily for periods of up to ten minutes whilst sedimented IMPs coalesce at the centre of the base. Moreover once a pellet of IMPs has formed it is not easily removed for analysis owing to the height of a conical flask and it is necessary to modify for example a "magnetic pipet" such as the commercially available PickPen™ product (Bio-Nobile Oy, Tykistokatu 4B, Turku 20521, Finland) in order to make it long enough to reach the bottom of the flask. Furthermore, as it simply rests on the summit of the curved base of the flask without any form of physical restraint the pellet is easily disturbed. Additionally it is not possible to see the pellet if the suspension is cloudy and as the inner flask base slopes away from the centre and glass is relatively slippery it is entirely unable to help the user by passively guiding the point of the pipet into the pellet and it was necessary to include a system whereby the pelletising magnet swings away to reveal a mirror by which the user can see both the pellet in the centre of the base and the tip of the pipet without bending over to peer upwards from beneath.

SUMMARY OF THE INVENTION

It was found that IMPs can rapidly be concentrated from relatively large samples of suspension, eg 250 mL, without need for tubes or pumps or noisy vibrations, if a suitably powerful magnet is mounted in an assembly that reduces its rapid decrease of flux density with distance and if the resultant magnetic field is directed into a suitably shaped and suitably agitated vessel and if said vessel and magnet are then moved in a particular manner relative to each other. The shape and dimensions of said vessel are selected to physically restrain the concentrated IMPs from dispersing and also acts as a guide for a pipet tip so that concentrated IMPs are easily transferrable to the next step of an analysis, for example by using the simple and inexpensive suction device known as a Pasteur pipet.

The present system is useful where bacteria, viruses or substances such as allergens, toxins, pesticides, etc (referred to herein as target analyte) are required to be captured for detection or identification.

The present invention provides a system to rapidly sediment and concentrate relatively large samples of IMPs for easy collection. The apparatus comprises a vessel for containing sample fluid having an inner base surface that slopes downwards towards a collection region, said collection region including a retrieval well for collecting magnetic particles; a magnet assembly for positioning under and in proximity with the vessel for attracting magnetic particles to the base surface of the vessel, the magnet assembly providing a relatively larger magnetic flux density at a peripheral region thereof; means for laterally traversing the magnet assembly relative to the vessel between a first position whereby the magnet is generally centered under the vessel and a second position whereby the peripheral portion of the magnet is positioned under the well of the vessel; and agitation means for agitating said vessel to facilitate movement of the magnetic particles to the well.

BRIEF DESCRIPTION OF THE DRAWINGS

FIG. 8 is a schematic sectional plan view of a portion of the apparatus as shown in FIG. 1 showing details of one embodiment of vessel driving and agitating means.

FIG. 9 is a schematic sectional side view of a portion of the apparatus shown in FIG. 8 showing details of one embodiment of the vessel agitating means.

FIG. 10 is a schematic sectional side view of a portion of the apparatus showing details of another embodiment of the vessel agitating means.

FIG. 11 is a schematic sectional side view of a portion of the apparatus showing details of another embodiment of the vessel agitating means.

FIG. 12 is a side view of the vessel and agitating means shown in FIG. 11.

FIG. 13 is a schematic sectional plan view of a portion of the apparatus showing details of another embodiment of the vessel agitating means.

FIG. 14 is a side view of the vessel and agitating means shown in FIG. 13.

DESCRIPTION OF THE PREFERRED EMBODIMENTS

Figure 1:
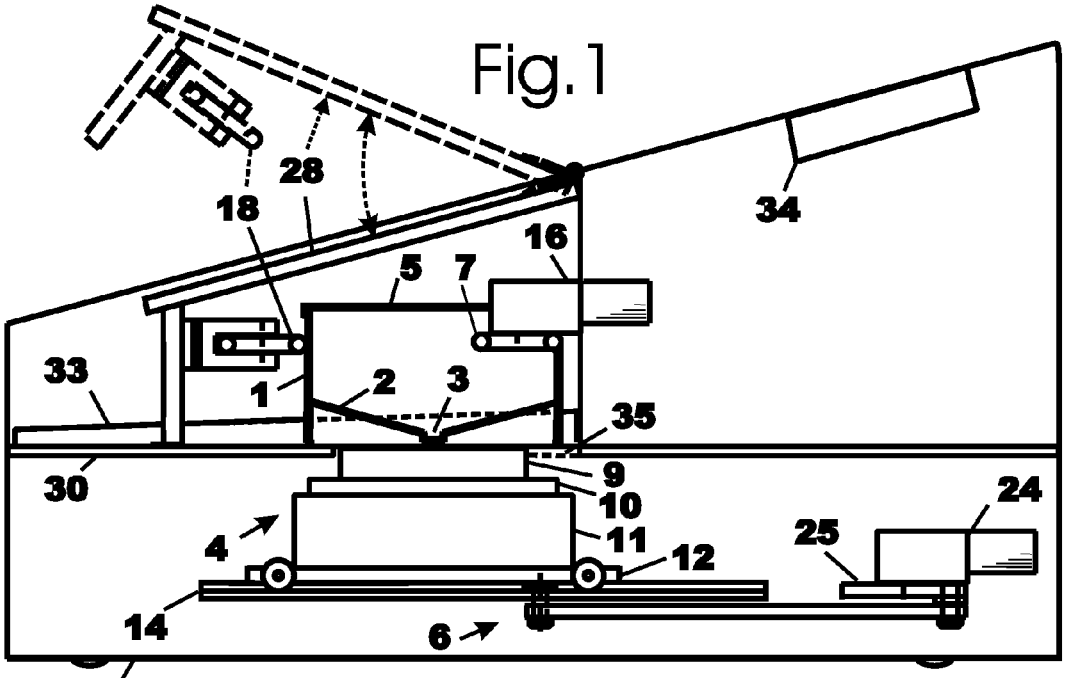
FIG. 1 is a schematic sectional side view of one embodiment of the apparatus of the present invention.
Figure 2:
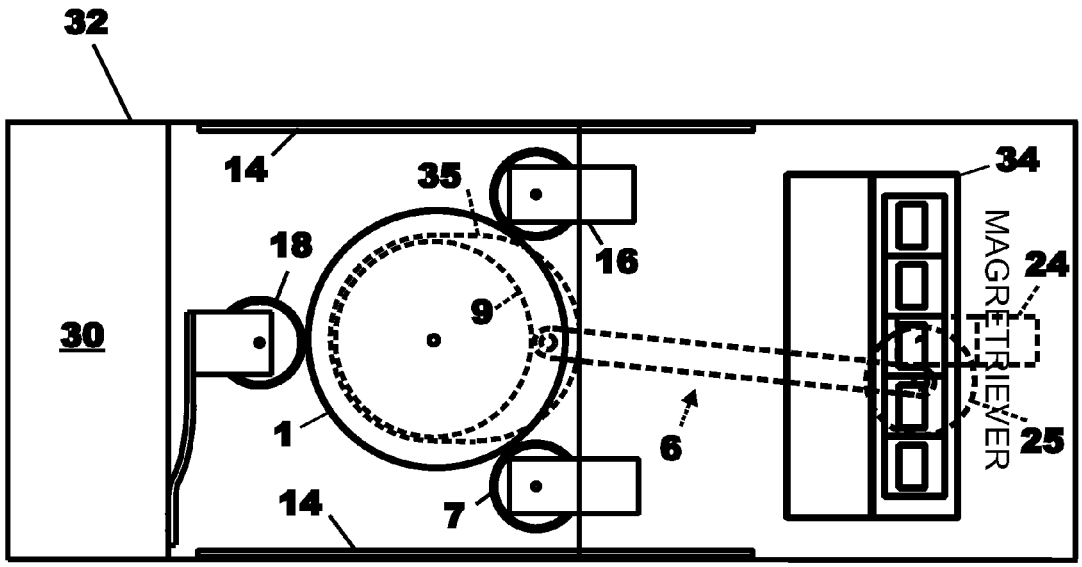
FIG. 2 is a schematic sectional plan view of the apparatus shown in FIG. 1.

With reference to FIGS. 1 and 2, the apparatus of the present invention comprises a vessel 1 for containing sample fluid having an inner base surface 2 that slopes downwards towards a well 3, in the form of a cavity in the base 2, for collecting magnetic particles. Positioned under and in proximity with the vessel 1 is a magnet assembly 4 for attracting magnetic particles to the bottom surface of the vessel towards the well. As detailed below, the magnet assembly is arranged to provide a relatively larger magnetic flux density at a peripheral region thereof.

Figures 3, 4, 5, 6, 7:
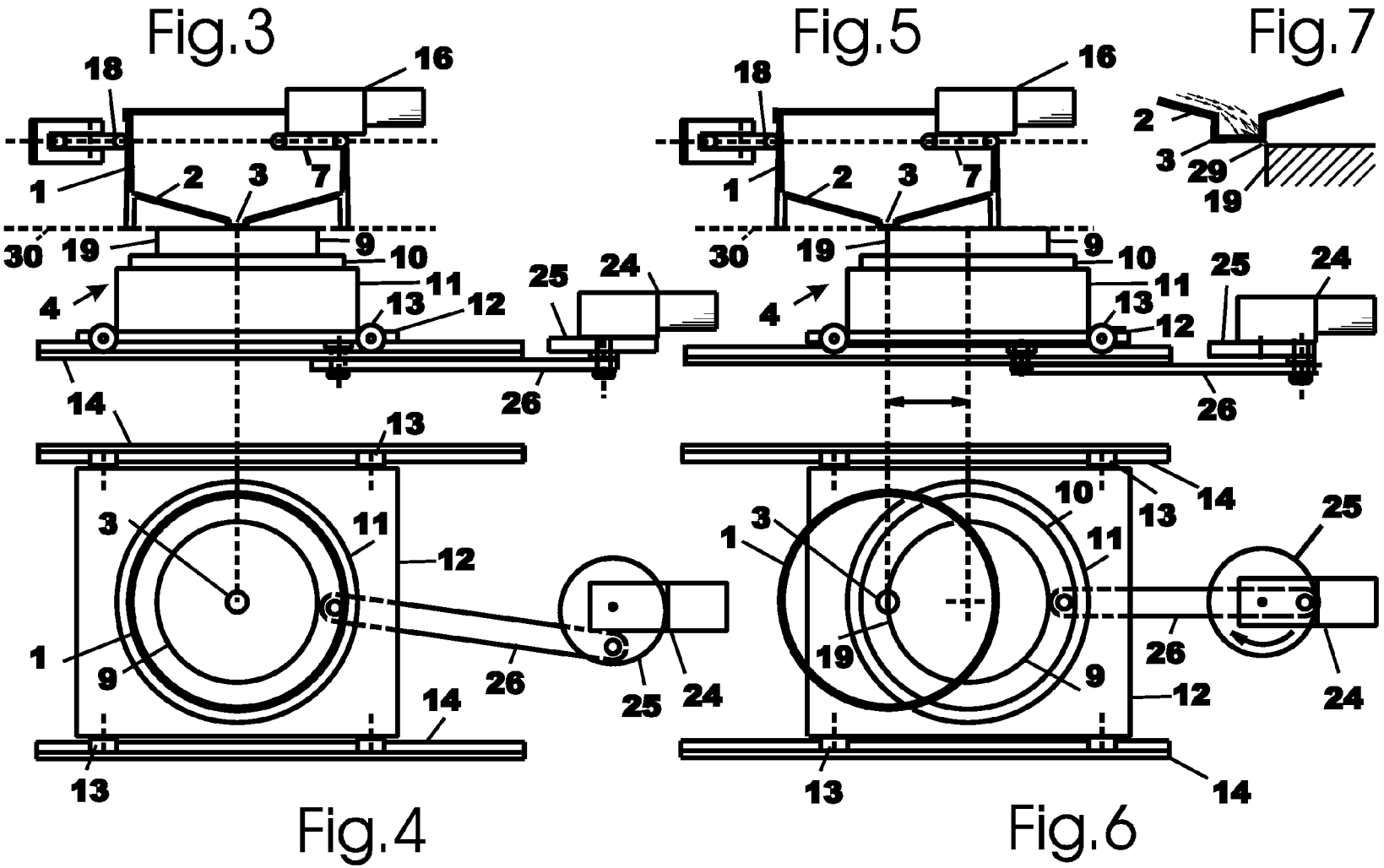
FIG. 3 is a schematic sectional side view of the apparatus of FIG. 1 showing one position of the magnet assembly relative to the vessel.
FIG. 4 is a schematic sectional plan view of the apparatus shown in FIG. 3.
FIG. 5 is a schematic sectional side view of the apparatus of FIG. 1 showing the magnet assembly moved to a second position in proximity with the well of the vessel, and distinct from the position shown in FIG. 3.
FIG. 6 is a schematic sectional plan view of the apparatus shown in FIG. 5.
FIG. 7 is a schematic sectional enlarged view of the well portion of the vessel shown in FIG. 5 illustrating the magnetic flux pattern produced by the magnet.

The magnet assembly 4 is shown laterally movable relative to the vessel 1 by magnet traversing/positioning means 6 adapted to move the magnet assembly 4 relative to the vessel 1 between a first position whereby the magnet assembly 4 is generally centered under the vessel 1, and a second position whereby the peripheral portion of the magnet is positioned under the well 3 of the vessel 1, as shown in FIG. 5 and detailed below. Agitation means, shown as motor driven wheel(s) 7, and detailed below, agitate the vessel to facilitate movement of the magnetic particles to the well 3, as described below.

Referring to FIGS. 1 and 2, vessel 1 has geometry and dimensions in relation to the magnet assembly 4 such that the magnetic field permeates the whole or part of the fluid suspension with a flux density sufficient to quickly sediment IMPs to the inner base surface 2 of the vessel 1 even from locations near the surface of the suspension. Vessel 1 is preferably but not necessarily of circular cross section and may be constructed of an easily mouldable and transparent plastic such as polycarbonate or polypropylene and for most purposes will be required to be sterile and not contain spurious DNA. The containing wall of vessel 1 preferably extends sufficiently above the suspension surface to minimize dangers of spillage but not so high as to make the centre of motion of the filled vessel high enough for an undesirable degree of pitching to occur when agitated. For 250 mL suspensions vessel dimensions found suitable were approximately 100 mm diameter and 50 mm high. It is desirable for vessel 1 also to have a lid 5 that fits loosely enough that it can be placed and removed without disturbing the suspension yet prevents its contamination by aerial contaminants during operation of the apparatus. It is also desirable to have a visible line or other demarcation at the desired volume level to aid when filling it.

The inner base surface 2 of vessel 1 slopes downwards towards the retrieval region, specifically the well 3, so as to facilitate migration of sedimented IMPs toward the well 3. A slope angle of about 15 degrees was found to be suitable. The inner surface of the vessel should be smooth in order to minimize stiction of IMPs that come into contact with it and thus facilitate their migration to its centre.

To minimize the tendency for the fluid to rise upwards during agitation, the vessel may be shaped to have a smaller diameter at the top than at the bottom. The lid 5 may also be utilized to ensure retention of the fluid.

The well 3 defines the terminal location where sedimented and concentrated IMPs are trapped until they are pipetted out. This well 3 preferably has a cylindrical shape and located to be close to the magnet 9 in operation. The dimensions of well 3 should have a large enough volume for it to hold all sedimented IMPs and of sufficient height to prevent their being pulled out of it again if vessel 1 is withdrawn horizontally away from the magnetic field yet not so deep that IMPs in the suspension above it are so far from the magnet assembly 4 that they experience a significantly weakened flux density. For most purposes well 3 can be about 2.5 to 4 mm deep and 5 to 8 mm diameter and its sides should be vertical or sloped at the minimum pitch angle required by molding practices but other dimensions may be acceptable depending on the quantity of IMPs likely to be used in the analysis.

With particular reference to FIGS. 3 to 6, the magnet assembly 4 has two functions, and to achieve these involves positioning the magnet assembly 4 relative to the vessel 1. Firstly, positioned as shown in FIGS. 3 and 4, the magnet assembly provides a magnetic field extending upwards through the volume of the vessel 1 with sufficient magnetic flux density as to rapidly sediment suspended IMPs to the base of vessel 1. Secondly, as shown in FIGS. 5 and 6, the magnet assembly is positioned, by means of magnet positioning means 6, to produce an intense magnetic field directed into the rim of well 3 and along the downward sloping base 2 of vessel 1 so that sedimented IMPs are pulled down into well 3, for retrieval.

A magnet assembly found suitable comprises a primary magnet 9, preferably of Neodymium-Iron-Boron alloy and of size covering at least half the base area of vessel 1. Primary magnet 9 will preferably be a disk of thickness at least one-tenth that of its diameter. For the vessel 1 described herein, magnet dimensions found to be suitable were about 76 mm diameter and 12 mm thick. A primary backplate 10 of high magnetic permeability and susceptibility such as mild steel or transformer iron is placed behind primary magnet 9. Primary backplate 10 has a larger diameter than primary magnet 9 and is preferably approximately the diameter of vessel 1 and of thickness at least one-fifth of the diameter of primary magnet 9. Suitable dimensions were found to be 100 mm diameter and 6 mm thickness. Primary backplate 10 should be in good contact with primary magnet 9 and more or less symetrically disposed around it and either be completely flat so that primary magnet 9 rests on its surface or recessed slightly to accept it. Primary backplate 10 modifies the magnetic field around primary magnet 9 by reducing the magnetic flux beneath it and increasing its strength in the upward direction into vessel 1. It was observed that primary backplate 10 typically increases the magnetic field strength at the halfway height of the vessel 1 approximately three-times compared with a naked primary magnet and the rate of decrease of magnetic flux density with distance also is reduced though to an extent somewhat dependent on lateral distance from the primary magnet centre.

It was found advantageous for the magnet assembly to have a secondary magnet 11 of even larger diameter underneath primary backplate 10 and a secondary backplate 12 underneath this. These secondary elements further bias the magnetic field upwards along the magnetic axis although secondary magnet 11 need not have the same strength as primary magnet 9. A single or stacked ceramic ring magnet of dimensions about 125 mm diameter and 25 to 50 mm thickness was found to be adequate for the secondary magnet 11. Secondary backplate 12 is larger than the secondary magnet 11 and includes rollers 13, forming a trolley that runs on rails 14 to facilitate moving the magnet assembly 4 relative to the vessel 1. It was observed that such magnet assembly, as shown, increases the magnetic field strength experienced by the contents near the base of the vessel 1 approximately six-times compared with a naked primary magnet whilst the magnetic flux density decreases more or less linearly with distance axially from the magnet surface for about 25 mm and then more rapidly at greater distances so that at a distance equivalent to the height of the surface of a 250 mL suspension in vessel 1 the flux density is only about one twenty-third (1/23) of that at the magnet surface. An important further observation revealed that the magnetic flux density at the surface of primary magnet 9 increases from the centre of its outer surface to its perimeter 19 such that the flux density acting at about 45 degrees to the vertical at its perimeter 19 is more than six-times that of the vertical flux density at its centre. Thus whilst magnetic objects anywhere within vessel 1 above magnet assembly 4 are pulled downwards more forcefully than they would be by a naked primary magnet alone they are also pulled much more forcefully towards perimeter 19 of primary magnet 9 rather than its centre once they get close to the surface of the magnet. If perimeter 19 is situated directly under well 3 the angle of the magnetic flux 29 is excellently pointed so as to pull sedimented IMPs along sloping base 2 and into well 3, as illustrated by FIG. 7.

The powerful upwardly-directed magnetic field provided by magnet assembly 4 rapidly sediments IMPs to the sloping base of vessel 1 and if this vessel were simply to be situated symmetrically above the magnet assembly 4 and agitated sufficiently intensely about its longitudinal axis so as to overcome stiction effects the IMPs would eventually migrate down its sloping base and into well 3. However it was observed that IMPs can be collected in well 3 much more rapidly by changing the relative positions of vessel 1 and magnet assembly 4 during the course of an IMP capture procedure such that at the beginning of a procedure vessel 1 is centred over and directly above primary magnet 9 so as to expose the suspension to the maximum possible volume of magnetic field whereby IMPs experience the maximum possible sedimenting force and then as the capture procedure progresses reducing incrementally to zero the distance between well 3 and the perimeter 19 of primary magnet 9 and at the same time introducing a relative rotation of vessel 1 with respect to primary magnet 9. One way of providing the necessary relative positioning and motion is to move vessel 1 orbitally but without rotating it about its own axis and with a steadily increasing radius around primary magnet 9 until well 3 is executing a horizontal trajectory directly above perimeter 19 of primary magnet 9. Disadvantages of such a motion are the area needed to execute it and a danger of spilling the contents of vessel 1 whilst it is being orbitally moved. It was found preferable to initially centre vessel 1 above primary magnet 9 during the initial sedimentation period and then whilst rotating vessel 1 about its axis gradually move magnet assembly 4 horizontally away from it until perimeter 19 of primary magnet 9 is directly beneath well 3. Magnet assembly 4, supported by backplate/trolley 12, travels along rails 14 which may simply be supports or be channeled so that rollers 13 are captive. This form of motion minimizes dangers of spillage and facilitates inclusion of gentle means to agitate vessel 1 adequately so as to overcome stiction if necessary such as repeatedly accelerating or decelarating its rotation, or by tapping means described herein below.

It will be appreciated that when vessel 1 is made to rotate it causes liquid in it to gradually assume the same angular velocity and at too high a rotational speed centripetal force could cause suspension to spill over the side of the vessel. However it will also be appreciated that angular acceleration of the suspension whilst it catches up with vessel 1 and conversely its deceleration when vessel 1 stops rotating both induce velocity gradients in the liquid that can result in movement of the upper layers of the suspension down to the bottom of vessel 1 where the magnetic flux density is much greater than exists near the surface as described above. Thus provided the overall angular velocity is not too high and provided the various acceleration and decelerations are sufficiently gentle those IMPs near the suspension surface that would otherwise experience only weak sedimenting forces because they are relatively far from magnet assembly 4 can be made to experience the strong sedimenting force existing near the bottom of vessel 1 and thus sediment faster than they would otherwise have done. The controller can be used to allow users to program retrieval procedures such as timing the stops and starts of rotation of vessel 1 so as to exploit this mixing and vary it to suit factors such as the viscosity of the suspension.

FIGS. 3 to 6 show an embodiment for traversing the magnet assembly relative to the vessel. In FIGS. 3 and 4 the magnet 9 is shown centralised under vessel 1 such as is required for optimum sedimentation rates of IMPs to the base 2 of the vessel. FIGS. 5 and 6 show the magnet moved laterally with the perimeter 19 of primary magnet 9 positioned directly under well 3. The magnet traversing mechanism includes gearmotor 24 bearing eccentric 25 and connecting rod 26 is pivotally connected to secondary baseplate 12 of the magnet assembly 4 such that as gearmotor 24 rotates magnet assembly 4 is reciprocated backwards and forwards along rails 14. The throw of eccentric 25 is arranged such that it moves magnet assembly 4 the required distance.

It will be apparent that other mechanisms could be employed for effecting the desired traversal of the magnet relative to the vessel, or by having the vessel moved relative to the magnet. Also, the apparatus may include means for automating the operation, with the use of additional components such as position sensors, actuators and controller.

In addition to providing motion of the vessel for the purpose of moving fluid around within the vessel, as described above, it is desirable to move the fluid relative to the surfaces of the vessel in order to overcome stiction experienced by IMPs that come into contact with base 2. This can be achieved by changing rotational motion, vibration or tapping of the vessel, for which embodiments are described below.

With reference to the embodiments of FIGS. 11 to 14, the vessel 1 has projections 20 formed by adjacent slots 21 that can be engaged actively by an agitating means or passively by suitable stationary catches and these slots are preferably though not necessarily located around the lower rim of the vessel beneath the outer edge of its sloping base. The vessel 1 as shown has slots 21 uniformly spaced around its lower rim 31 permitting it to adapt if necessary to a variety of anti-stiction means or protocols, for example, by being tapped inside each slot by oscillating tapping means so that it simply oscillates about its longitudinal axis, or being engaged by gearlike teeth or capstan that cause it to rotate intermittently about its axis or passively tapped by being rotated past tapping means such as a spring-loaded tappet. However other means for agitating the vessel may be employed For example, for IMPs that sediment and migrate easily the vessel may simply be rotated or vibrated by rotating or vibrating means pressing on its outer wall.

Referring to FIGS. 8 and 9, rotation means is shown as three rotatable elements spaced at approximately 120 degrees. One or two of these rotatable elements can be used to rotate vessel 1 and comprise gearmotors 16 each of which carries a driving wheel 7 suitably tired with rubber or other frictionable material to make friction contact with the wall of vessel. The other non-driven rotatable element(s) is a freely rotatable free wheel 18 pressed by spring arm 19 against the wall of vessel 1 with sufficient force that driving wheels 7 reliably rotate vessel 1 when it contains fluid. As shown, free wheel 18 is positioned on the cover 28 so as to be out of the way when vessel 1 is placed in the apparatus but presses against it when cover 28 is closed. By suitable choice and control of gearmotors 16 it is possible to impart continuous or jerking motions to vessel 1 so as to facilitate both sedimentation and overcoming stiction of IMPs against base 2.

It will be apparent that other mechanisms such as stepper motors could be employed instead of gearmotors for imparting the necessary agitating motions to vessel 1. The intermittent jerking motion of a stepper motor as it indexes can be utilized to provide the desired agitation as well as the rotational motion for overcoming stiction of the magnetic particles.

Referring to FIG. 10 an alternative arrangement to provide stiction overcoming agitation to the vessel, uses driving wheels 17 and free wheel 18 which are placed lower so that they ride over the slots 21 and thus impact the adjacent projections 20 of the vessel 1 repeatedly as it turns.

Referring to FIGS. 11 and 12, vessel 1 is constrained by three elements such as freely rotating wheels 18 at 120 degree intervals. Tongue 22 projecting through a slot 21 oscillates through an angle sufficient to impact the adjacent projection at each oscillation, thus causing vessel 1 to execute small stiction-overcoming rotational oscillations inside its constraining wheels.

Referring to FIGS. 13 and 14, vessel 1 is constrained by three elements such as wheels at 120 degree intervals and a capstan 23 having spokes of smaller diameter than the width of a slot 7 is positioned so that its spokes can enter slots 21. Capstan 23 is arranged to rotate thus causing vessel 1 also to rotate as shown and because its spokes do not retain continuous contact with slots 21 as would, for example, gear teeth they impact projections 20 at each contact thereby imparting stiction-overcoming impacts to sedimented IMPs.

It will be understood that other methods may be used for inducing motion in vessel 1 in order to overcome stiction and ensure sedimentation and concentration of IMPs. It will be appreciated that motion of the fluid by the agitating means must be limited to avoid re-mixing of the IMPs and impeding sedimentation.

FIG. 1 shows an enclosure 32 which encloses and supports the various components and shields its contents from contamination during IMP capturing procedures. It should also protect both user and apparatus from harm or damage associated with the possibility of ferrous objects being accidentally brought into a strong magnetic field. Cover 28 can be raised to allow vessel 1 to be inserted into the apparatus until it contacts and stops at driving wheels 7 and lowering cover 28 traps vessel 1 between driving wheels 7 and wheel 18 where it is constrained for rotary motion.

Support plate 30 is provided with a recess 35 as necessary to permit primary magnet 9 to be close to vessel 1 and also permit moving from being centred under it to where perimeter 19 is under well 3. Tray 33 of thin wear resistant material and low magnetic permeability protects magnet 9, supports the rotating vessel 1, and contains spillage from vessel 1. As shown in FIG. 2, the case incorporates a control panel 34 and encloses the various electronic components that may be used to activate and control the various components of the apparatus.

In operation, the vessel 1 containing the sample is placed in the apparatus positioned centered on the magnet assembly 4, as shown in FIGS. 3 and 4. The vessel 1 is agitated, for example by rotation, as described above, to provide mixing or circulation of the fluid in order to bring the major portion thereof at some point in proximity with the magnet facilitating the sedimentation of the magnetic particles from all areas of the vessel. Furthermore, the agitation overcomes stiction of the particles that accumulate at the base of the vessel, and would otherwise impede migration to the well 3. After the desired sedimentation time period, the magnet assembly 4 is moved relative to the vessel 1 whereby the peripheral high magnetic flux region 19 of the magnet is positioned under the well 3 of the vessel, as shown in FIGS. 5 & 6, facilitating migration of the magnetic particles to the well 3.

Operation of the apparatus may be made automatic, whereby upon introducing a filled vessel 1 into position the apparatus executes a predefined time/intensity protocol for agitation of the vessel and the positioning of the magnet assembly 4. For users who prefer to vary the capture protocol, a timer, speed control and various intermittent movements can be added to the capabilities of the apparatus. It is also possible to arrange for the apparatus to be controlled by external computer.

What is claimed is:

1. An apparatus for concentrating magnetic particles suspended in a fluid comprising:

a vessel for containing said fluid having an inner base surface that slopes downwards towards a collection region, said collection region including a retrieval well for collecting magnetic particles;

a magnet assembly for positioning under and in proximity with the vessel for attracting magnetic particles to the inner base surface of the vessel, said magnet assembly providing a relatively larger magnetic flux density at a peripheral region thereof;

means for laterally traversing the magnet assembly relative to the vessel between a first position whereby the magnet is generally centered under the vessel and a second position whereby the peripheral portion of the magnet is positioned under the well of the vessel; and agitation means for agitating said vessel to facilitate movement of the magnetic particles to the well.

2. The apparatus of claim 1 wherein the agitation means comprises rotation means for rotating the vessel.

3. The apparatus of claim 2 wherein the rotation means provides rotation alternately in opposite directions to facilitate relative movement of fluid and vessel.

4. The apparatus of claim 1 wherein the agitation means includes vibrating means to facilitate movement of the magnetic particles along the bottom of the vessel towards the well.

5. The apparatus of claim 1 wherein the magnet assembly comprises a primary magnet, and a backing plate having high magnetic permeability below the primary magnet, for increasing the magnetic flux density at the vessel.

6. The apparatus of claim 5 wherein the magnet assembly further comprises a secondary magnet and secondary backing plate below the backing plate of the primary magnet, and wherein the secondary magnet and secondary backing plate have a larger cross-section than the primary magnet.

7. The apparatus of claim 1 including control means for controlling movements of said vessel and positioning of the magnet relative to the vessel.

8. The apparatus of claim 1 wherein said vessel has a smaller diameter at its top than at its base to facilitate retention of the fluid upon rotation and agitation.

9. A method for concentrating magnetic particles suspended in a fluid comprising:

providing a vessel for containing said fluid having an inner base surface that slopes downwards towards a collection region, said collection region including a retrieval well for collecting magnetic particles;

providing a magnet assembly for positioning under and in proximity with the vessel for attracting magnetic particles to the inner base surface of the vessel, said magnet assembly providing a relatively larger magnetic flux density at a peripheral region thereof;

agitating said vessel to facilitate movement of the magnetic particles to the well; and traversing the magnet assembly relative to the vessel between a first position whereby the magnet is generally centered under the vessel and a second position whereby the peripheral portion of the magnet is positioned under the well of the vessel.

10. The method of claim 9 wherein agitating the vessel includes rotation.

* * * * *